US010557323B2

(12) United States Patent
Pope

(10) Patent No.: US 10,557,323 B2
(45) Date of Patent: Feb. 11, 2020

(54) DRILLING FLUID FILTER SCREEN AND METHOD OF USE

(71) Applicant: Hunting Energy Services, Inc., Houston, TX (US)

(72) Inventor: Jason Michael Pope, Magnolia, TX (US)

(73) Assignee: Hunting Energy Services, LLC, Houston, TX (US)

( * ) Notice: Subject to any disclaimer, the term of this patent is extended or adjusted under 35 U.S.C. 154(b) by 0 days.

(21) Appl. No.: 16/008,572

(22) Filed: Jun. 14, 2018

(65) Prior Publication Data

US 2019/0383110 A1 Dec. 19, 2019

(51) Int. Cl.
*E21B 21/06* (2006.01)
*E21B 3/02* (2006.01)

(52) U.S. Cl.
CPC ..... *E21B 21/065* (2013.01); *E21B 3/02* (2013.01); *E21B 21/062* (2013.01)

(58) Field of Classification Search
CPC ..... E21B 21/065
See application file for complete search history.

(56) References Cited

U.S. PATENT DOCUMENTS

| | | | | |
|---|---|---|---|---|
| 6,598,685 | B1 | 7/2003 | Mashburn | |
| 6,976,546 | B2 | 12/2005 | Herst | |
| 9,421,484 | B2 | 8/2016 | Ford | |
| 9,598,919 | B1 | 3/2017 | Cantrell et al. | |
| 2002/0180613 | A1* | 12/2002 | Shi | G01V 11/002 340/853.1 |
| 2018/0313178 | A1* | 11/2018 | Biggerstaff | E21B 21/08 |

* cited by examiner

*Primary Examiner* — Kristyn A Hall
(74) *Attorney, Agent, or Firm* — Whitaker Chalk Swindle & Schwartz PLLC; Charles Gunter

(57) ABSTRACT

A filter screen assembly is shown for filtering drilling mud used during oil and gas well drilling operations. The filter screen assembly is installed at the surface of a well on the discharge side of the mud pump at ground level. The filter screen assembly is installed upstream of the rig swivel, rotary hose and Kelly and downstream of the discharge from the mud pump. Since it is located at ground level, it does not pose the safely hazard associated with elevated components. It does not need to be removed and reinstalled when additional segments are added to the drill string and is always easily accessible for routine maintenance or replacement.

8 Claims, 6 Drawing Sheets

DRILLING FLUID FILTER SCREEN AND METHOD OF USE

BACKGROUND OF THE INVENTION

1. Field of the Invention

The present invention relates to filter screen assemblies used to filter drilling mud of the type used in downhole drilling technologies in the oil and gas industries and to a method for installing such a filter screen assembly in a well bore drilling operation.

2. Description of the Prior Art

The "mud" circulating system is used to circulate drilling fluid down through the drill string and up the annulus, carrying the drilled cuttings from the face of the bit to surface and will be familiar to those skilled in the relevant arts. Among the main functions of the circulating drilling fluid are to clean the borehole of cuttings made by the drill bit, to cool the drill bit head, and to exert a hydrostatic pressure sufficient to prevent formation fluids from entering the borehole.

Drilling fluid (mud) is usually a mixture of water, clay, weighting material, such as barite, and chemicals. The mud is mixed and conditioned in mud pits or tanks located at the well surface and is then circulated downhole by large pumps. These pumps are typically present at the ground level, for example, adjacent the rig floor or at subfloor or substructure of the rig. These are typically reciprocating positive displacement pumps, for example Triplex Pumps™. These types of pumps are well known in the industry and are often used because they can operate over a wide range of pressure and pump fluids containing high solids content and tend to be relatively reliable and easy to operate and maintain.

In the case of a typical drilling rig, the mud is pumped through, for example, a standpipe, rotary hose, a swivel, and a Kelly and then down the drill string. At the bottom of the borehole, the mud passes through the bit and then up the annulus between the drill string and surrounding well bore, carrying cuttings up to surface. On surface the mud is directed from the annulus, through a mud return line back to the mud tanks and ultimately back to the mud pumps. However, before it re-enters the mud tanks, the drilled cuttings are removed from the drilling mud by some type of solids removal equipment. The used mud may also be reconditioned in other ways.

Once the drilled cuttings have been removed from the mud it is re-circulated down the borehole. The mud is therefore in a continuous circulating system. The properties of the mud are checked continuously to ensure that the desired properties of the mud are maintained. If the properties of the mud change then chemicals will be added to the mud to bring the properties back to those that are required to fulfil the functions of the fluid. The chemicals may be added, for example, while the drilling fluid is being circulated through the mud tanks.

As has been mentioned, during drilling operations as the mud is being circulated, it begins to accumulate suspended drilled cuttings, as well as some gas or other possible contaminants. These must be removed before the mud is recycled. In a typical operation, the mud passes over a shale shaker, which is basically a vibrating screen. This will remove the larger particles, while allowing the residue (underflow) to pass into settling tanks. The finer material can be removed using other solids removal equipment. If the mud contains gas from the formation it will be passed through a degasser which separates the gas from the liquid mud. Having passed through all the mud processing equipment the mud is returned to the mud tanks for recycling.

The debris which the drilling mud picks up can affect the flow of the mud and the operation of the drill bit and other tools. In addition to the mud conditioning equipment previously described at the well surface, in the past, a filter screen subassembly was often installed in the drill string to help collect and filter debris. Downhole filter screens are run, for example, during directional drilling operations and are sometimes installed near the drill bit at the bottom of the drill string and thus are not easily accessible during drilling. In some cases, to remove or clean out a downhole filter screen, the entire drill string must be pulled out of the wellbore.

U.S. Pat. No. 6,598,685, issued Jul. 29, 2003, to Mashburn, is a typical prior art drilling system in which a down hole filter screen is used. As described in the patent, a filter screen is placed within the box end of a tubular member by a worker located in the monkey bars of the derrick. A kelly or top drive is attached to the tubular members so that the drilling of a bore hole with the drilling bit may proceed. In the case of a top drive, the top drive and tubing string is lowered by the derrick draw works as drilling proceeds. The operator has the option of retrieving the screen from the rig floor before coupling the tubular to another tubular joint. The screen can also be kept within the drilling tubular as a second joint of drilling tubular is threadedly connected in the string.

Once the drilling tubulars are lowered into the well bore, the filter screen can no longer be removed by hand since the drilling tubulars are now threadedly coupled together. When it is desired to retrieve the screen, a wire line unit is used to retrieve the screen with a special pulling tool. The pulling tool would latch onto a fishing neck of the screen and the filter screen would then be pulled from the drilling tubulars to the well surface.

The above described procedure is time consuming and somewhat complicated. Also, prior art downhole filter screens can be damaged during drilling operations. Filters in the drill string are subject to washing. Also, if a filter screen fills with debris and is not properly maintained or cleaned, then it can cause blockages in the fluid flow or other problems. In some extreme cases, the filter screen may shear off due to excess debris buildup or excess vibration during drilling operations. The broken filter screen can be pushed by the fluid flow of the drilling mud and may end up at the bottom of the borehole. Due to the inconveniences from factors such as installation, cleaning, and maintenance, filter screens are sometimes not used by drilling operators despite the benefits they provide in filtering drilling mud.

Because of these kinds of problems with downhole filter screens, surface pipe screens are also sometimes used to filter drilling mud. In the past, these pipe screens were typically installed in the drill string above the surface, typically at an elevated position on the drilling rig, and they are designed to catch finer particulates than downhole filter screens. They may be part of a top drive, for example, or in close proximity to the top drive, at an elevation located above the rig floor.

U.S. Pat. No. 6,976,546, issued Dec. 20, 2005, to Herst, is a typical prior art drilling mud filtration system using a filter screen which is disposed within a drilling mud fluid passageway that extends from the entry point of the drilling mud into the overhead drilling system on the top drive unit.

Specifically, the overhead drilling system includes a wash-pipe assembly, having a gooseneck extending therefrom for receiving an S-pipe and the mud filter screen is disposed within the S-pipe. The S-pipe is located immediately adjacent the upper end of the top drive unit at an elevated position on the drilling rig.

These prior art surface filter screen systems also suffer from various disadvantages. In the case of some of the prior art top drive arrangements, each time a new drill pipe segment is ready to be added to the drill string, the top drive must be disconnected from the drill string. Before connecting the new drill pipe segment, the installed surface pipe screen must be removed from the topmost box end of drill pipe in the drill string. After the new drill pipe segment is connected to the drill string, the surface pipe screen can be reinstalled into the new drill pipe segment's box end, and the top drive can be reconnected with the drill string. If the surface pipe screen is ever forgotten when adding new segments of pipe, the surface pipe screen may become "lost" in the drill string, making its retrieval difficult and tedious. Further, if a surface pipe screen ever shears off, it may become lodged along with debris anywhere in the drill string.

Additionally, the traditional surface pipe screens installation which were installed on the top drive or adjacent the top drive had the potential to present safety issues Many drilling operators enforce a safety zone around the drill string when the top drive is disconnected from the drill string. In some cases, operators forgo the use of surface pipe screens, rather than risk the safety of personnel during the frequent insertion and removal of a surface pipe screen during drilling operations.

Accordingly, there exists a need for the safe and easy attachment and removal of a filter screen assembly that overcomes many of the problems described with respect to the prior art filter screens.

SUMMARY OF THE INVENTION

The following invention presents a novel design for a filter screen assembly used in a variety of different conventional mud circulation systems of the type used on oil and gas well drilling rigs. The filter screen assembly is installed at the surface of a well on the discharge side of the mud pump typically at ground level, for example, as a part of the substructure of the rig. It does not need to be removed and reinstalled when additional segments are added to the drill string and is always easily accessible for routine maintenance or replacement. Since it is located at ground level, it does not present the safety hazards that some of the prior art arrangements presented where filtering devices were placed at elevated locations on the drill rig.

A method of drilling a well bore is shown which uses the improved filter screen assembly of the invention, where drill bit cuttings and other abrasive debris and contaminants are filtered from a drilling mud that is circulated from a surface mud tank through an oil or gas well drilling system. The filtering system is located on a well drilling rig having a rig floor and a rig derrick, the method comprising the steps of:

providing a drill string;

providing a drilling system supported by the well derrick that rotatably drives the drill string for drilling a well bore, the drilling system including a stand pipe, a rotary hose, a swivel and a Kelly positioned at an elevated level above one end of the drill string, the drill string also having a drilling mud fluid passageway;

locating a mud pump at a well surface location for circulating the drilling mud from the mud tank to the drilling mud fluid passageway of the drill string, the mud pump having a pump inlet and a discharge outlet;

providing an interconnecting conduit downstream of the mud pump, between the mud circulating pump and the drill string;

providing a mud filter screen assembly for filtering the drilling mud, the mud filter screen assembly being positioned in the interconnecting conduit adjacent the discharge outlet of the mud pump at a surface level which is prior to the interconnecting conduit rising to the elevated level of the rotary hose and swivel on the well derrick.

The drilling rig may be provided with a stand pipe that is located in the interconnecting conduit between the discharge outlet of the mud pump and the remainder of the drill string on the derrick, the stand pipe being positioned in a generally upright position in the derrick. In this case, the filter screen assembly used in the method of the invention will be positioned in the interconnecting conduit adjacent the discharge outlet of the mud pump at a surface level on the rig floor or floor substructure and prior to the stand pipe. In any case, the filter screen assembly will be located at ground level, for example, as a part of the substructure of the rig.

The mud filter screen assembly may assume various configurations, but will in any case be a porous structure, typically made of metal, having a plurality of openings along a length thereof which allows a flow of drilling mud through the filter screen portion of the assembly, while trapping drill bit cuttings, shavings and other abrasive debris. For example, the filter screen porous structure may be selected from the group consisting of metal mesh material, a plurality of welded metal bars, or a generally solid metal tube having a plurality of longitudinal opening formed therein. The filter screen porous structure could also be made from a variety of synthetic materials such as Nylon or various hard plastics.

Additional features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
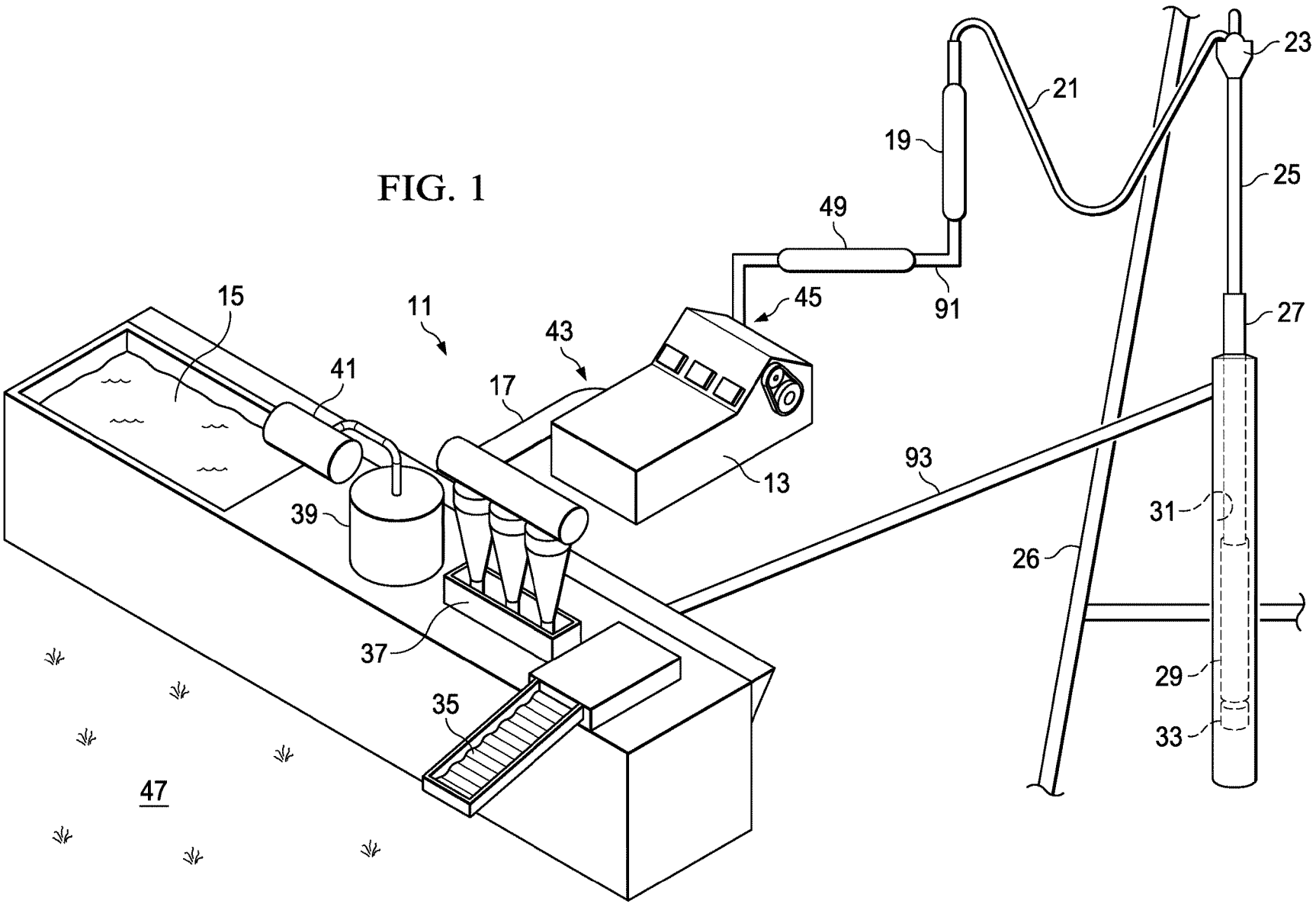
FIG. 1 is a simplified, partly schematic view of a drilling mud system showing the principal components thereof and showing the location of the in-line mud filter screen assembly of the invention.

As has been described in some detail in the Background discussion above, in the oil and gas industry, downhole drilling operations may drill boreholes that extend thousands of feet into the ground. Drilling muds are used to facilitate such drilling operations. FIG. 1 is a simplified schematic which shows how drilling mud circulates through a typical drilling mud circulation system. The drilling rig shown in FIG. 1 is intended to be a simplified view of a generic mud circulation system, designated generally as 11 which, in this case, also includes the mud filter screen of the invention (49 in FIG. 1). Mud pumps 13 pump the mud from mud tanks or mud pits 15 ("mud tanks" hereafter) through a suction line 17 located at the surface. The mud is then pumped through a stand pipe 19, through a rotary hose 21 and through a swivel 23 and Kelly 25 to the top of the stand of drill pipe (the "drill pipe string") 27. The conventional well derrick is indicated in broken-away, schematic fashion as 26 in FIG. 1.

The mud is further pumped through a drilling mud fluid passageway (internal bore) of the drill pipe string 27 to a bottom hole assembly and drill bit 33. In the simplified view shown in FIG. 1, the drill pipe 27 is shown supporting a drill collar 29 which is located within the well annulus 31 at a selected downhole location. The bottom hole assembly may assume a variety of configurations and may contain, for example, electrical and microprocessor components embedded within tools such as measurement while drilling assemblies. As it reaches the bottom of the borehole, the mud acts to cool and clean the drill bit 33. The mud also picks up rock formation cuttings and other debris and circulates them back up through the annulus 31 between the drill string 27 and casing, returning ultimately to the mud tanks 15. The mud may also be processed through a shale shaker 35, desander 37, desilter 39 and a degasser 41, or other conditioning equipment, before returning to mud tanks 15 to start the process of being pumped downhole again.

As has been mentioned, prior art drilling systems often employed a filter screen assembly in addition to the shale shakers, vibrating screen, etc., present at the well surface, to further filter the recirculating drilling mud. These filter screens were typically placed either in the drill string, or in an elevated position on the drilling rig, as for example, being incorporated into some part of a top drive assembly or adjacent to such an assembly. In any event, the filter screen assemblies were located above the rig floor or within a section of the drill pipe itself. The various disadvantages that result from such an arrangement have been discussed.

In the method of the present invention, a drilling system such as the system shown in simplified fashion in FIG. 1, is used to drill a well bore. The simplified schematic shown in FIG. 1 is intended to be a generic view of a typical mud circulation system of the type used with a conventional rotary table. The rig could also just as easily be a "top drive" type rig, which will be well familiar to those skilled in the relevant arts. Again with reference to FIG. 1, the method of the invention utilizes the principal components of the mud circulation system previously described. As has been described, the drill string 27 includes a mud fluid passageway within the interior thereof. The mud pump 13 receives mud from the mud tanks 15 through the suction line 17. Mud is drawn through a pump inlet 43 and discharges from a pump discharge outlet 45 on its way to the stand pipe 19, rotary hose 21 and Kelly 25, as previously described. Note that the stand pipe 19 is positioned in a generally upright position in the derrick. All of this is conventional drilling technology. It should also be noted that the mud tanks and mud pumps of the mud circulating system are typically located at the well surface level, i.e., at ground level or as a part of the substructure of the rig. In FIG. 1, "ground level" is indicated schematically as 47.

Unlike the prior art systems, in the method used in the present invention, the filter screen assembly (49 in FIG. 1) is located in the fluid conduits which are located adjacent the discharge outlet 45 of the mud pump 13 at a surface level, generally prior to the stand pipe 19. Where the derrick and drilling system includes a rotary hose, swivel and Kelly connecting the drill string to the stand pipe 19, the mud filter screen assembly will be located upstream of these components. In any event, the filter screen assembly will be located at ground level, for example, as a part of the substructure of the rig.

Figure 2:
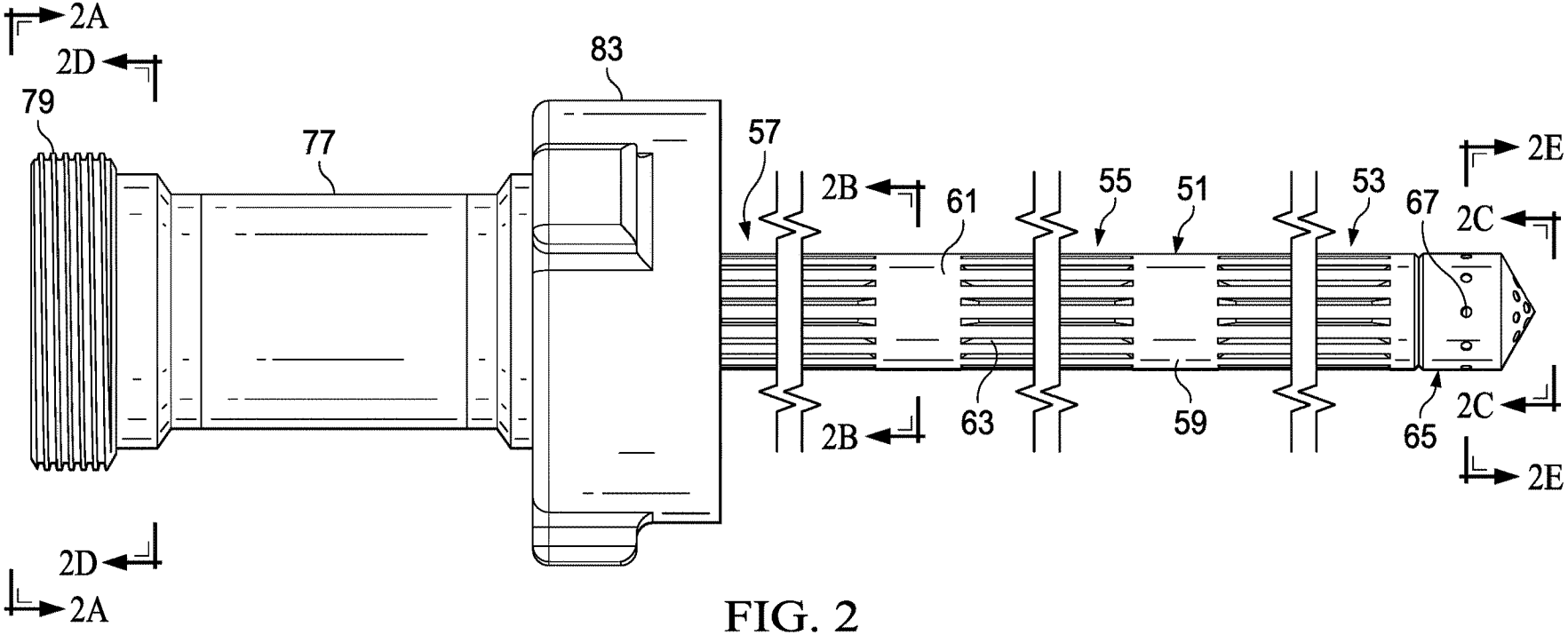
FIG. 2 is a side perspective view of the filter screen section of the filter screen assembly used in the practice of the present invention.
Figure 2A:
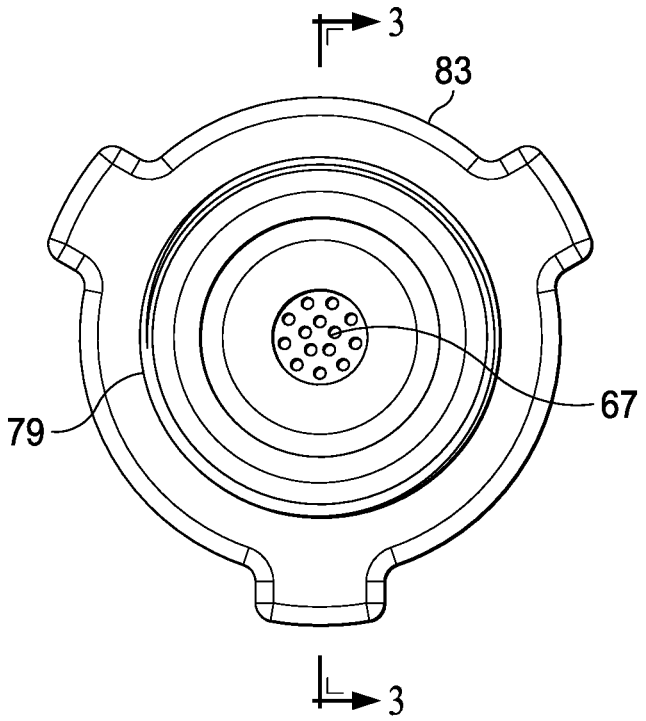
FIG. 2A is a left end view of the filter screen section of FIG. 2.
Figure 2B:
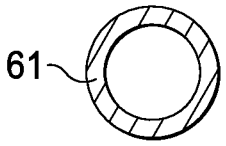
FIG. 2B is a cross sectional view taken along lines 2B-2B in FIG. 2.
Figure 3:
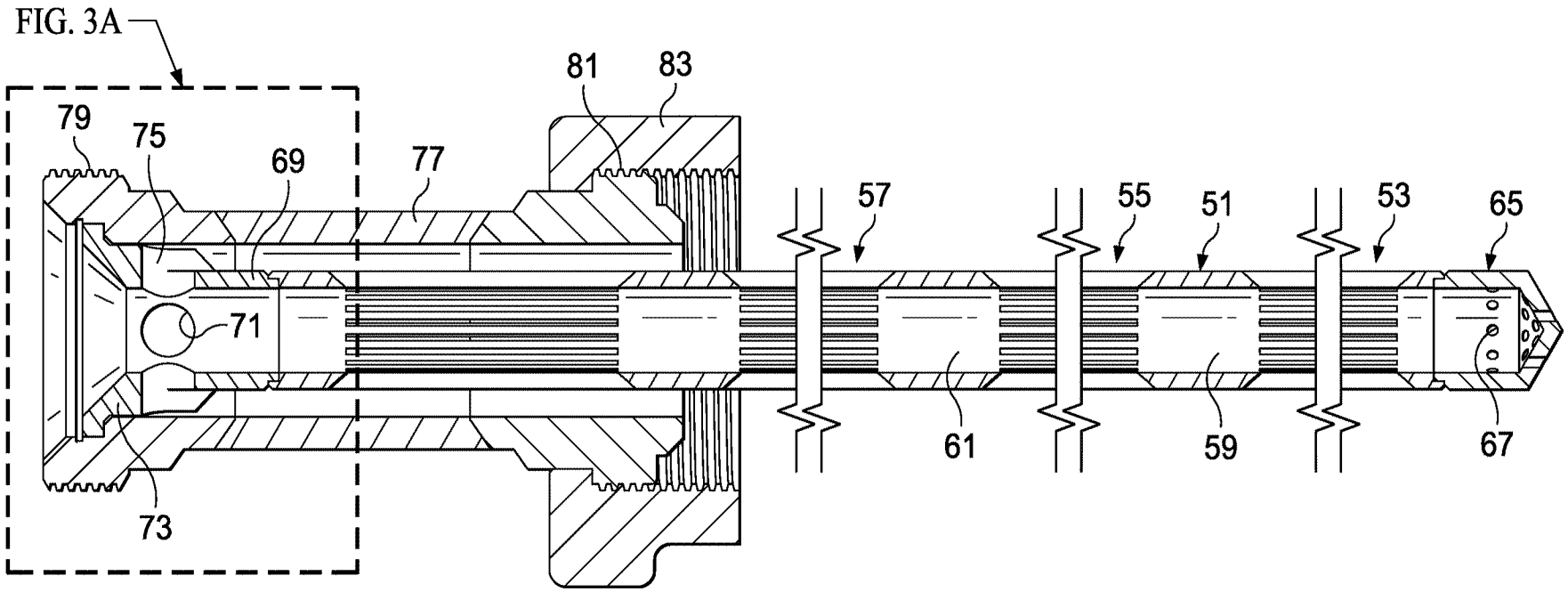
FIG. 3 is a side, cross sectional view of the filter screen of FIG. 2.
Figure 3A:
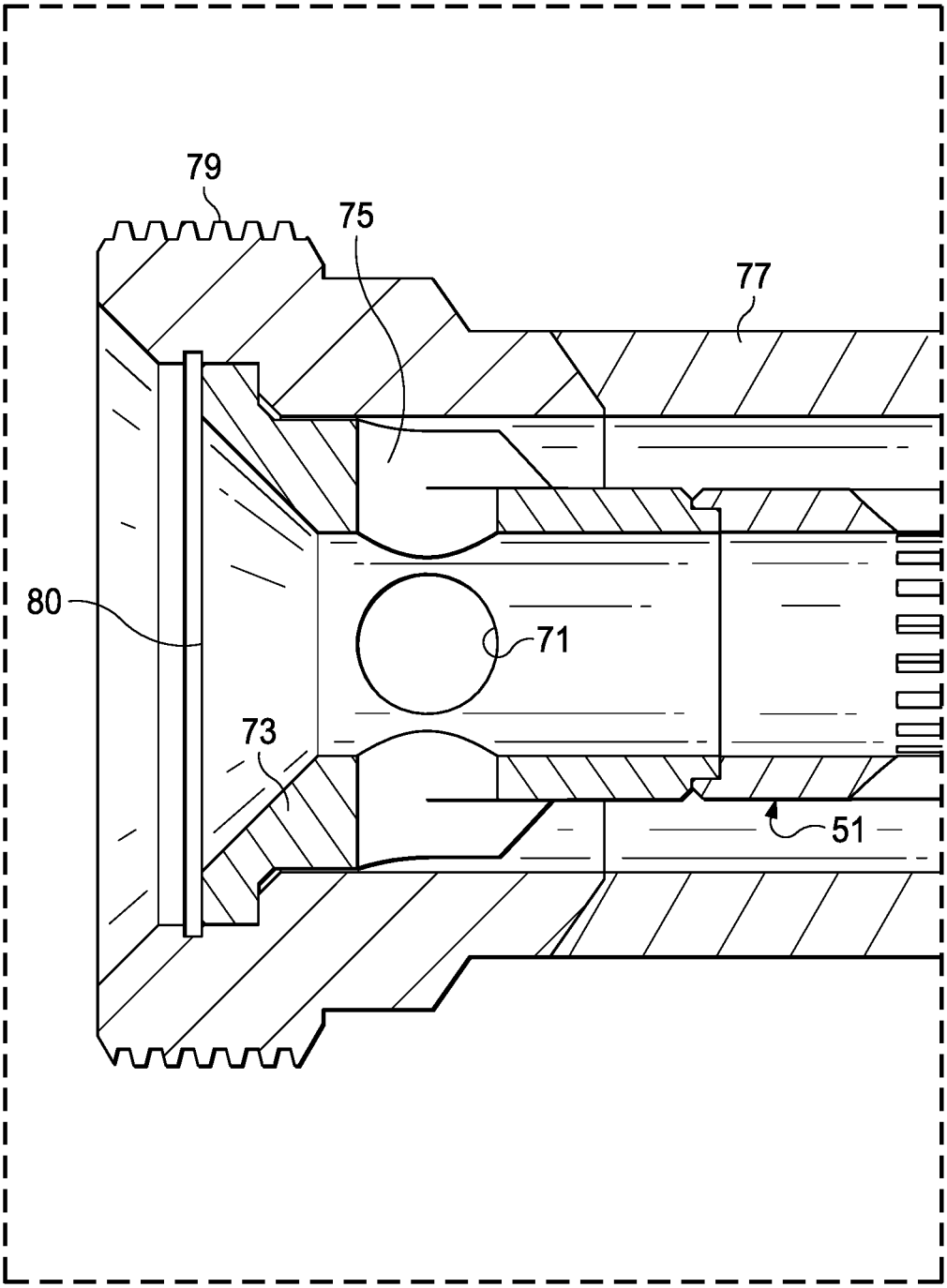
FIG. 3A is an enlarged side cross sectional view of the flared inlet piece of the filter screen section of FIG. 3.

FIGS. 2-3A show one preferred form of the filter screen assembly of the invention. The filter screen apparatus shown FIG. 2 is a porous structure, preferably made of metal, such as a suitable steel, having a plurality of openings along a length thereof which allows a flow of drilling mud through the filter screen while trapping drill bit cuttings and other abrasive debris and contaminants. The filter screen itself can assume various forms, for example, the filter screen can be selected from the group consisting of metal mesh material, a plurality of welded metal bars, or a generally solid metal tube having a plurality of longitudinal opening formed therein, as by machining or milling. As mentioned, the porous structure of the filter screen could also be made from a variety of synthetic materials, such as Nylon and various hard plastics.

In the preferred embodiment shown in FIGS. 2 and 3, the filter screen section of the assembly takes the form of a cylindrical tube 51 having spaced slotted regions, such as regions 53, 55, 57. The slotted regions are separated by solid cylindrical regions 59, 61. Section 2B is a cross sectional view of one of the cylindrical regions 61. Each of the slotted regions 53, 55, 57, has a plurality of longitudinally extending slots (such as slot 63 in section 55).

Figure 2C:
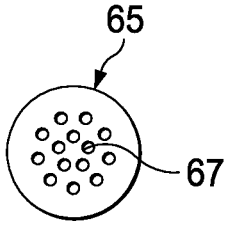
FIG. 2C is an end view taken along lines 2C-2C in FIG. 2.
Figure 2D:
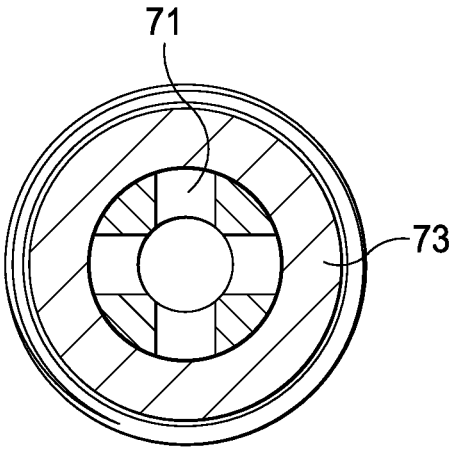
FIG. 2D is a cross sectional view taken along lines 2D-2D in FIG. 2.
Figure 2E:
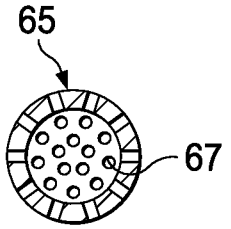
FIG. 2E is a cross sectional view taken along lines 2E-2E in FIG. 2.
Figure 4:
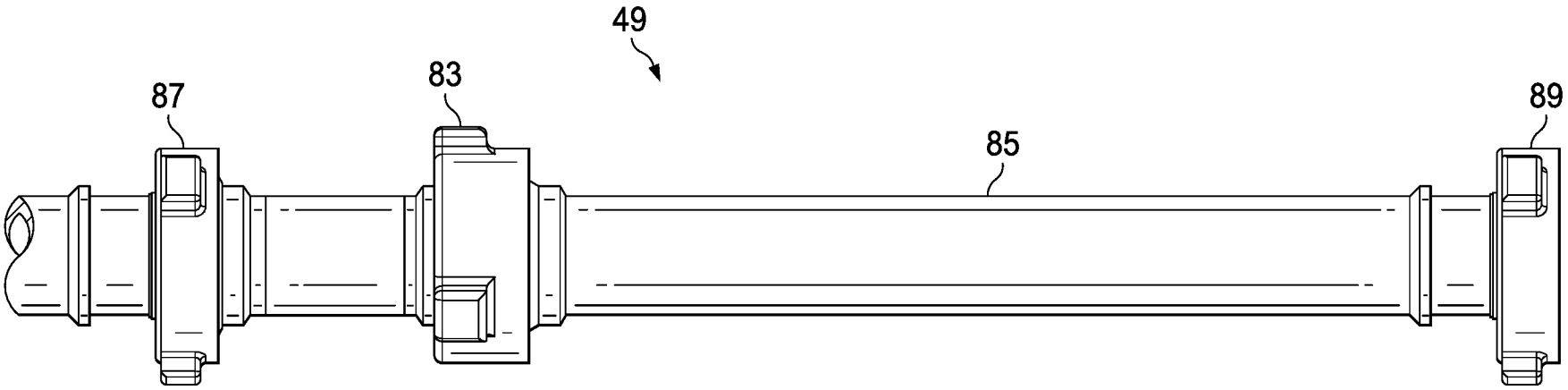
FIG. 4 is a side, perspective view of the filter screen assembly of the invention.

The length of the filter screen itself terminates in an end cap 65 having a plurality of end openings 67. FIG. 2C is an end view of the end cap 65 while FIG. 2E is a cross sectional view of the end cap 65. As best seen in FIG. 3, the cylindrical tube portion 51 of the filter screen section opposite the end cap 65 is welded to a metal inlet piece 69. The inlet piece 69 has a generally cylindrical length with side port openings 71 and is joined to a flared end region 73. Four alignment tabs (such as tabs 75 are welded to the inlet piece 69 between the four opposing port openings 71 for centering the inlet piece 69 within an end fitting 77. The end fitting 77 has oppositely arranged outer threaded extents 79, 81, for engaging coupling members (such as the internally threaded coupling member 83 shown in FIGS. 3 and 4). An O-ring groove (80 in FIG. 3A) is provided for receiving an O-ring seal for forming a seal with a cooperating member of the overall filter screen assembly once the filter screen section is received within the outer tubular assembly, as shown in FIG. 4.

The coupling members, such as member 83, can be traditional "hammer unions" of the type that will be familiar to those skilled in the relevant arts. As best shown in FIG. 4, the hammer union 83 is used to enclose the filter screen assembly within the outer steel tubular member (85 in FIG. 4). Other conventional hammer unions 87, 89, shown in FIG. 4, are used to position the filter assembly at a selected location in the fluid conduit system which connects the mud pump discharge with the drill string, as previously described.

During drilling operations, used mud returns to the mud tanks 15 through a return line (93 in FIG. 1). After treatment, the mud will flow into the filter screen assembly from the discharge outlet 45 of the mud pump 13. As debris collects at the bottom of the filter screen, mud flow may be diverted through the sides of the cylindrical tube region 51, through the spaced slotted regions 53, 55, 57, and into an annular passageway that exists between the filter screen section and the outer tubular member (85 in FIG. 4) within the filter screen assembly. The mud will then flow through the remainder of the filter screen assembly and into the fluid conduit (91 in FIG. 1) which connects the filter assembly with the drill string.

An invention has been provided with several advantages. The filter screen system of the invention has the ability to put the filter screen on the discharge side of the mud pump, thereby eliminating the need for other types of filter screens such as top drive screens, surface screens, downhole filters, and the like. Unlike the filter screens presently offered in the marketplace, the present system is not tied to a specific rotary connection size and would eliminate that need. The prior art systems typically require removal and reinsertion on every stand of pipe, and this need would be eliminated by the present system. The present system can be utilized with any of a number of drilling rigs with the screen assembly simply being placed in-line in the mud circulation system. It stays with the drilling fluid system which is specific to the drilling rig at hand.

What is claimed is:

1. A method for filtering drill bit cuttings and other abrasive debris and contaminants from a drilling mud that is circulated from a surface mud tank through an oil or gas well drilling system located on a well drilling rig having a rig floor and a rig derrick, the method comprising the steps of:

providing a drill string;

providing a drilling system supported by the well derrick that rotatably drives the drill string for drilling a well bore, the drill string having a drilling mud fluid passageway;

providing an interconnecting conduit downstream of the mud circulating pump for communicating with the drilling mud fluid passage in the drill string;

wherein the drilling system includes a stand pipe that is located in the interconnecting conduit between a discharge outlet of the mud pump and the remainder of the drilling system on the derrick, the stand pipe being positioned in a generally upright position;

providing a mud filter screen assembly for filtering the drilling mud, the mud filter screen assembly being positioned in the interconnecting conduit adjacent the discharge outlet of the mud pump at ground level and prior to the stand pipe;

the mud filter screen assembly comprising a porous structure made of metal having a plurality of openings formed along a length thereof which allows a flow of drilling mud through the filter screen section while trapping drill bit cuttings and other abrasive debris;

wherein the mud filter screen assembly includes a filter screen section having a longitudinal axis, the filter screen section being mounted within an outer tubular member, whereby an annular passageway exists between the filter screen section and the outer tubular member, the filter screen assembly having a filter inlet for receiving mud flow from the discharge outlet of the mud pump and a filter outlet, and wherein drilling mud enters the filter inlet in an in-line direction and continues axially through the mud filter screen assembly and through the annular passageway, parallel to the longitudinal axis of the filter screen section and to the outer tubular member, the flow continuing to the filter outlet where it passes through the interconnecting conduit and from there through the drilling mud fluid passageway of the drilling system; and wherein the mud filter screen assembly has an inlet piece provided with at least one by-pass outlet which allows the flow of mud to continue outside the filter screen section in the annular passageway between the filter screen section and the outer tubular member and thereafter along the longitudinal axis of the outer tubular member to the filter outlet in the event the filter screen section itself should become clogged or inoperative.

2. The method of claim 1, wherein the filter screen section porous structure is selected from the group consisting of metal mesh material, a plurality of welded metal bars, a generally solid metal material having a plurality of openings machined therein, Nylon and hard plastic materials.

3. The method of claim 2, wherein the derrick and drilling system includes a rotary hose, a swivel and a Kelly, the Kelly being positioned at an elevated level above one end of the string of drill pipe, the filter screen assembly being located upstream of the rotary hose, swivel and Kelly.

4. The method of claim 3, wherein the drilling rig has a floor level and a substructure and wherein the filter screen assembly is located at ground level as a part of the substructure of the drilling rig.

5. A mud filter system for filtering drill bit cuttings and other abrasive debris and contaminants from a drilling mud that is circulated from a surface mud tank through an oil or gas well drilling system located on a well drilling rig having a rig floor and a rig derrick with a rig floor substructure, the drilling system further including as components thereof a drill string on the derrick with a rotatable drive for driving the drill string for drilling a well bore, the drill string having a drilling mud fluid passageway, and at least one mud pump having an inlet and a discharge outlet, the mud pump being located at a well surface level on or partly below the rig floor for circulating the drilling mud from a mud tank to the drilling mud fluid passageway of the drill string, the mud filter system comprising:

an interconnecting conduit between the discharge outlet of the mud circulating pump and the drill string;

a mud filter screen assembly for filtering the drilling mud, the mud filter screen being positioned in the interconnecting conduit adjacent the discharge outlet of the mud pump at ground level as a part of the rig substructure;

wherein the mud filter screen assembly includes a filter screen section which is a porous structure made of metal having a plurality of openings along a length thereof which allows a flow of drilling mud through the filter screen section while trapping drill bit cuttings and other abrasive debris;

wherein the mud filter screen assembly includes a filter screen section having a longitudinal axis, the filter screen section being mounted within an outer tubular member, whereby an annular passageway exists between the filter screen section and the outer tubular member, the filter screen assembly having a filter inlet for receiving mud flow from the discharge outlet of the mud pump and a filter outlet, and wherein drilling mud enters the filter inlet in an in-line direction and continues axially through the mud filter screen assembly and through the annular passageway, parallel to the longitudinal axis of the filter screen section and to the outer tubular member, the flow continuing to the filter outlet where it passes through the interconnecting conduit and from there through the drilling mud fluid passageway of the drilling system; and wherein the mud filter screen assembly has an inlet piece provided with at least one by-pass outlet which allows the flow of mud to continue outside the filter screen section in the annular passageway between the filter screen section and the outer tubular member and thereafter along the longitudinal axis of the outer tubular member to the filter outlet in the event the filter screen section itself should become clogged or inoperative.

6. The mud filter system of claim 5, wherein the drilling system includes a stand pipe that is located in the interconnecting conduit between a discharge outlet of the mud pump and the remainder of the drilling system on the derrick, the stand pipe being positioned in a generally upright position relative to the derrick, and wherein the filter screen assembly is located prior to the stand pipe.

7. The mud filter system of claim 6, wherein the derrick and well drilling system includes a swivel, a rotary hose and a Kelly connecting the drill string to the stand pipe, the mud screen filter being located upstream of the swivel, rotary hose and Kelly.

8. The mud filter system of claim 5, wherein the filter screen porous structure is selected from the group consisting of metal mesh material, a plurality of welded metal bars, a generally solid metal material having a plurality of openings machined therein, Nylon and plastic materials.

* * * * *